US012297613B2

(12) United States Patent
Mosher et al.

(10) Patent No.: US 12,297,613 B2
(45) Date of Patent: May 13, 2025

(54) SYSTEMS AND METHODS FOR RETRIEVING, TRANSPORTING AND DISPOSING OF PET WASTE

(71) Applicant: MOSHER GROUP LLC, Naperville, IL (US)

(72) Inventors: Paul Kenneth Mosher, Naperville, IL (US); Jeffrey Alan Mosher, Sandwich, IL (US)

(73) Assignee: MOSHER GROUP LLC, Naperville, IL (US)

( * ) Notice: Subject to any disclaimer, the term of this patent is extended or adjusted under 35 U.S.C. 154(b) by 188 days.

(21) Appl. No.: 17/719,011

(22) Filed: Apr. 12, 2022

(65) Prior Publication Data

US 2023/0323616 A1 Oct. 12, 2023

(51) Int. Cl.
*E01H 1/00* (2006.01)

(52) U.S. Cl.
CPC ..... *E01H 1/006* (2013.01)

(58) Field of Classification Search
CPC ..... A01K 23/005; A01K 1/0014; E01H 1/006
USPC ..... 294/1.3, 1.4, 1.5
See application file for complete search history.

(56) References Cited

U.S. PATENT DOCUMENTS 4,225,174 A 9/1980 Hennessy et al.
5,400,572 A * 3/1995 Peck ..... E01H 1/1206 294/1.3
5,503,442 A 4/1996 Lee
5,775,258 A * 7/1998 Larsen ..... A01K 1/0114 294/1.3
6,039,368 A * 3/2000 Kowalczyk ..... A01K 1/0114 294/1.3
6,116,549 A * 9/2000 Santa Cruz ..... B65B 67/12 248/97
6,199,737 B1 3/2001 Ringelstetter
6,983,966 B2 1/2006 Azrikam
7,063,365 B1 6/2006 Chase
7,131,552 B2 * 11/2006 Simonson ..... B65F 1/10 220/495.06
7,132,004 B2 11/2006 Rhodes
7,374,215 B2 5/2008 Anderson
7,410,197 B2 * 8/2008 Edwards ..... E01H 1/1206 294/1.3
7,695,034 B2 4/2010 Anderson
D624,714 S 9/2010 Brochu
(Continued)

*Primary Examiner* — Paul T Chin
(74) *Attorney, Agent, or Firm* — MARSHALL, GERSTEIN & BORUN LLP

(57) ABSTRACT

A product for retrieving, transporting and disposing pet waste that may reduce and/or eliminate the use of plastic bags, yet provide storage during transport until the waste may be properly disposed. A retrieval mechanism (e.g. a scoop) may be integrated into a handled cover assembly that may also attach to and/or form a seal with a container. In operation, a user may retrieve excrement with the retrieval mechanism, then position the scoop/lid inside the container, allowing the retrieval mechanism to be inside the container. When so positioned, the waste may drop into the container for storage and transportation. The container may be made of rigid antimicrobial plastic with high lubricity/low frictional characteristics and/or corrosion-resistant materials, and biodegradable bags, a second opening dump door or bag-drop door, and/or a hands-free carrying capabilities also may be provided.

21 Claims, 19 Drawing Sheets

(56) References Cited

U.S. PATENT DOCUMENTS

| | | | | |
|---|---|---|---|---|
| D642,749 | S * | 8/2011 | Tancs | D30/162 |
| 8,578,885 | B2 | 11/2013 | Franklin | |
| 8,714,604 | B1 | 5/2014 | Mihalic | |
| 8,985,653 | B1 | 3/2015 | Kest | |
| 9,004,555 | B1 | 4/2015 | Chirico | |
| 9,091,031 | B2 | 7/2015 | Naseem | |
| 9,382,679 | B2 * | 7/2016 | Bevans | E01H 1/1206 |
| 9,657,449 | B2 | 5/2017 | Swetish | |
| 9,975,660 | B2 * | 5/2018 | Cartledge | A47K 5/1201 |
| 10,028,489 | B1 | 7/2018 | Smith, Jr. | |
| 10,041,220 | B1 | 8/2018 | Johnson, IV | |
| 11,884,439 | B2 * | 1/2024 | Zeitz | B65D 25/52 |
| 2008/0179902 | A1 | 7/2008 | Phillips et al. | |
| 2014/0183886 | A1 * | 7/2014 | Hollett | A01K 1/0114 294/1.3 |

* cited by examiner

SYSTEMS AND METHODS FOR RETRIEVING, TRANSPORTING AND DISPOSING OF PET WASTE

FIELD OF THE DISCLOSURE

The present embodiments relate generally to animal waste collection, specifically, the retrieval, transportation and disposal of pet waste.

BACKGROUND

Pets positively enrich the lives of their owners in many ways. For example, dogs provide companionship, contribute to an active lifestyle, provide emotional and physical support services and the like. Around 38% of US households are estimated to have one or more dogs.

Current environmental concerns as well as national laws, state legislature and county, city or municipal ordinances aim to reduce or eliminate the production, distribution and even use of plastic bags. As it is beneficial for both the 90 million pet dogs and the pet's human companion to incorporate regular exercise into a daily or weekly routine, a system was needed to provide a hygienic, durable and reusable system to maintain sanitary conditions in both public or private spaces.

Previous prior art approaches to handling and treatment of pet waste include cupped devices or bag holders on extended braces or garments to be attached to the animal to catch fecal matter before it hits the ground. Others employ a device either mechanical or simple in design to surround and lift the excrement from the surface with and/or without the use of a disposable bag. These devices and systems can be encumbering, inefficient, prone to leaking, detrimental to the environment or even outright banned in some jurisdictions.

BRIEF SUMMARY

This Summary is provided to introduce a selection of concepts in a simplified form that are further described in the Detailed Description. This Summary is not intended to identify key features or essential features of the claimed subject matter, nor is it intended to be used to limit the scope of the claimed subject matter.

The present embodiments may, inter alia, provide for the efficient and environmentally responsible retrieval, transportation and/or disposal of solid excrement from canines or other pets. In certain embodiments, the system may include a retrieval apparatus (e.g. scoop, claw, jaws or the like) that is integrated into a handled lid assembly that attaches to and/or forms a seal with a solid container. In operation, a user may retrieve the excrement with the scoop/lid, then position the scoop/lid to the solid container, allowing the scoop retaining the waste material to enter the container. When so positioned, the waste may drop into the container for storage and transportation. In some embodiments, this accumulation and storing process may be performed multiple times whereupon the user can re-secure the lid to the container for transportation.

The lid and container may form a seal such that the excrement and any associated smell may be kept inside the container. The pet waste may then be carried to its appropriate disposal location. For example, the user may empty the container into a private septic or sewage system, an approved public disposal container, or the like.

In some embodiments, the container may include a second opening or access port for removing the excrement from the container. The access port may, for example, be disposed near the end distal the primary opening. A second cover may be provided to close and/or seal the secondary opening, such as, for example, a hinged door or the like. This secondary opening also may be used with a biodegradable or flushable liners (or the like), providing another option for positioning the liner in the interior chamber of the container.

In certain embodiments, antimicrobial materials such as antimicrobial plastic technology or other sturdy and non-corrosive materials (such as stainless steel, carbon fiber and the like) may be used to form some or all of the components and will reduce and/or eliminate the need for plastic bags or other disposable waste capture components.

In certain embodiments, the pet waste retrieval, transporting and disposal system may include a container and a locking lid with integrated scoop. For example, the lid may include a latch that engages a detent (or a receiving tab) on the container. Alternatively, or additionally, the latch may be disposed on the container and the detent may be disposed on the lid, or any other mechanism may be used to fixedly secure the lid to the container. The user may disengage the lid from the container by releasing the latch from detent (or second latch) and separating the container and lid at the interlocking connection.

In some embodiments, the pet waste retrieval, transporting and disposal system may include fastened elastic elements that will restrain the cover assembly securely to the container assembly when positioned in an overlapping manner.

In some embodiments, the container assembly may be attachable to or nestled into a harness worn by the user, enabling the user to transport the pet waste retrieval, transporting and disposal system hands-free. The container may be detached from the harness when necessary. Additional uses are further disclosed and described in the embodiments herein.

The systems and methods described herein also may include additional, less, or alternate functionality, including that discussed elsewhere herein.

Advantages will become more apparent to those of ordinary skill in the art from the following description of the preferred embodiments which have been shown and described by way of illustration. As will be realized, the present embodiments may be capable of other and different embodiments, and their details are capable of modification in various respects. Accordingly, the drawings and description are to be regarded as illustrative in nature and not as restrictive.

BRIEF DESCRIPTION OF THE DRAWINGS

The Figures described below depict various aspects of the system and methods disclosed herein. It should be understood that each Figure depicts an embodiment of a particular aspect of the disclosed system and methods, and that each of the Figures is intended to accord with a possible embodiment thereof. Further, wherever possible, the following description refers to the reference numerals included in the following Figures, in which features depicted in multiple Figures are designated with consistent reference numerals.

There are shown in the drawings arrangements which are presently discussed, it being understood, however, that the present embodiments are not limited to the precise arrangements and instrumentalities shown, wherein.

Figure 1A:
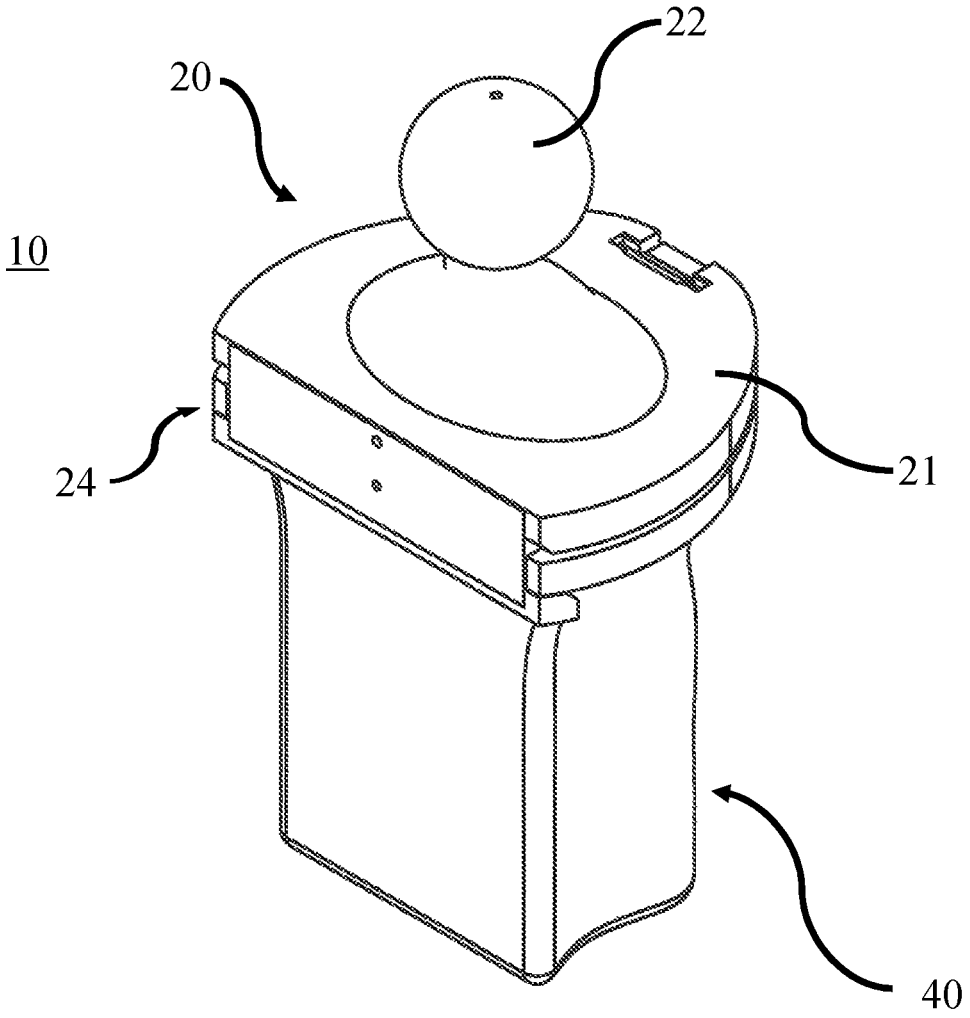
FIG. 1*a* is a perspective view of an exemplary pet waste retrieval, transporting and disposal system in accordance with one embodiment.
Figure 1B:
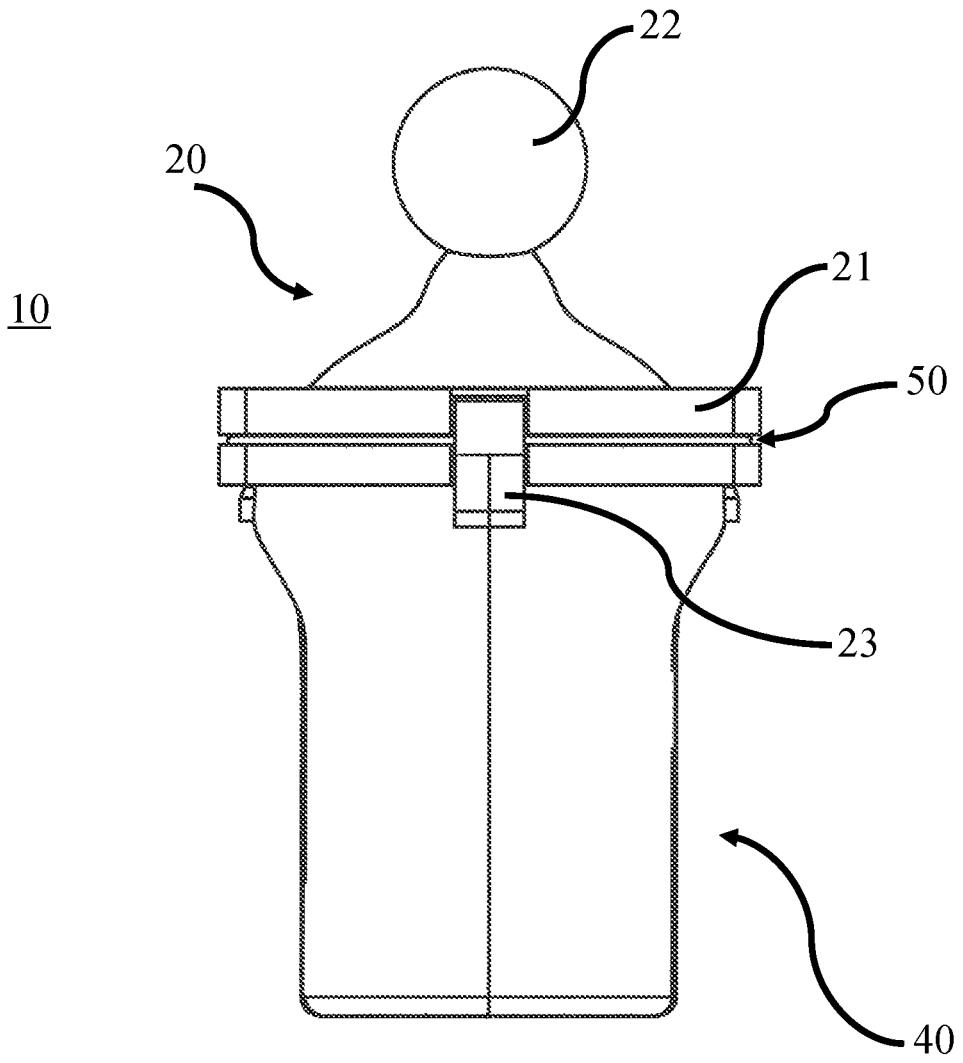
FIG. 1*b* is a front view of the exemplary pet waste retrieval, transporting and disposal system of FIG. 1*a;*
Figure 1C:
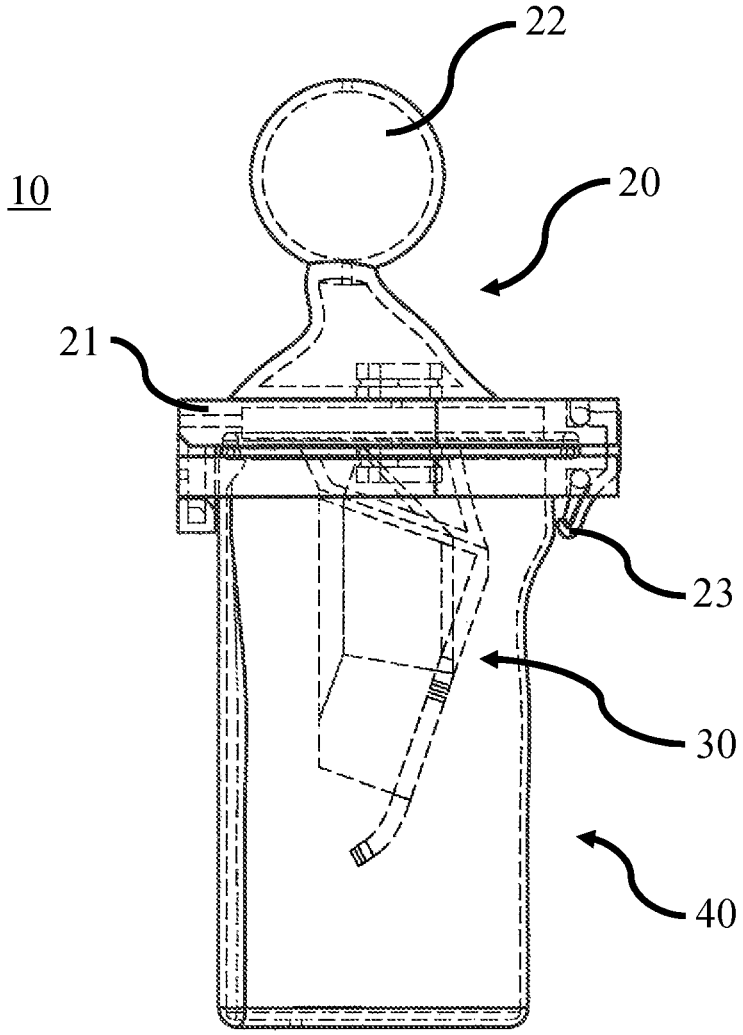
FIG. 1*c* is a side sectional view of the exemplary pet waste retrieval, transporting and disposal system of FIG. 1*a;*

The Figures depict certain embodiments for purposes of illustration only. Alternative embodiments of the systems and methods illustrated herein may be employed without departing from the principles of the invention described herein.

DETAILED DESCRIPTION

Although the following text sets forth a detailed description of numerous different embodiments, it should be understood that the legal scope of the description is defined by the words of the claims set forth at the end of this patent and equivalents. The detailed description is to be construed as exemplary only and does not describe every possible embodiment since describing every possible embodiment would be impractical. Numerous alternative embodiments could be implemented, using either current technology or technology developed after the filing date of this patent, which would still fall within the scope of the claims.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based upon any statement made in any section of this patent (other than the language of the claims). To the extent that any term recited in the claims at the end of this patent is referred to in this patent in a manner consistent with a single meaning, it is done for sake of clarity only so as not to confuse the reader and it is not intended that such claim term be limited, by implication or otherwise, to that single meaning. Finally, unless a claim element is defined by reciting the word "means" and a function without the recital of any structure, it is not intended that the scope of any claim element be interpreted based upon the application of 35 U.S.C. § 112(f).

Pet Waste Retrieval/Transporting/Disposal System Overview

Referring to the drawings and initially FIGS. 1*a*-1*e* an exemplary system 10 for the retrieval, transporting and disposal of solid pet excrement is shown. Although the system 10 is primarily described herein in the context of retrieving, transporting and disposing of dog excrement, it should be understood by one of ordinary skill in the art that the embodiments and descriptions are exemplary in nature and not limiting. As illustrated, the system 10 includes a cover assembly 20 and a container assembly 40. The cover assembly 20 may include a handle portion 22, a lid 21, and a retrieval member 30 for retrieving excrement. The cover assembly 20 may be coupled to the container assembly 40 so that the lid 21 closes the container assembly 40. In some embodiments, this coupling may cause a seal to form between the lid assembly 20 and container assembly 40. Alternative or additionally, the lid assembly 20 may be able to be locked to the container assembly 40, such as by latch 23.

In operation, a user may retrieve the excrement from a grassy nook or other location deemed suitable by the canine by using the retrieval member 30. Once the excrement is secured, the retrieval member 30 may be positioned within an interior chamber 45 (FIG. 6*a*) of the container assembly 40, and the cover assembly 20 may be coupled to and close the container assembly 40. When so positioned, the waste may drop into the container assembly 40 for storage and transportation. The system also reduces and/or prevents odor from escaping. In some embodiments, this accumulation and storing process may be performed multiple times whereupon the user can re-secure the lid to the container for transportation. The pet waste may then be carried to its appropriate disposal location. For example, the user may empty the container into a private septic or sewage system, an approved public disposal container, or the like.

To clean the system 10, the user may utilize conventional methods such as water streams, scrubbing or the like. In addition, a user may fill some or all of interior chamber 45 with a cleaning solution, close the container assembly 40 with lid assembly 20, and agitate any undesired material by shaking or other method. Optionally, a user may allow the solution to soak inside interior chamber 45 for some time.

The various components of the system may be made of any suitably rigid material and non-corrosive materials, such as stainless steel, carbon fiber, acetal resin, thermoplastic polymer, or the like. In some embodiments, materials having antimicrobial properties may be used to form some or all of the components and may reduce and/or eliminate the need for plastic bags or other disposable waste capture components. Other similar wear resistant materials having low static and dynamic coefficients of friction and capable of being formed into the parts described herein are considered to fall within the scope of the claimed inventions. Other materials also may be used. In some embodiments, each component is made of the same material. Alternatively or additionally, one or more of the components of the system may be made of different material than others of the components.

Exemplary Cover Assemblies 20

Figure 2A:
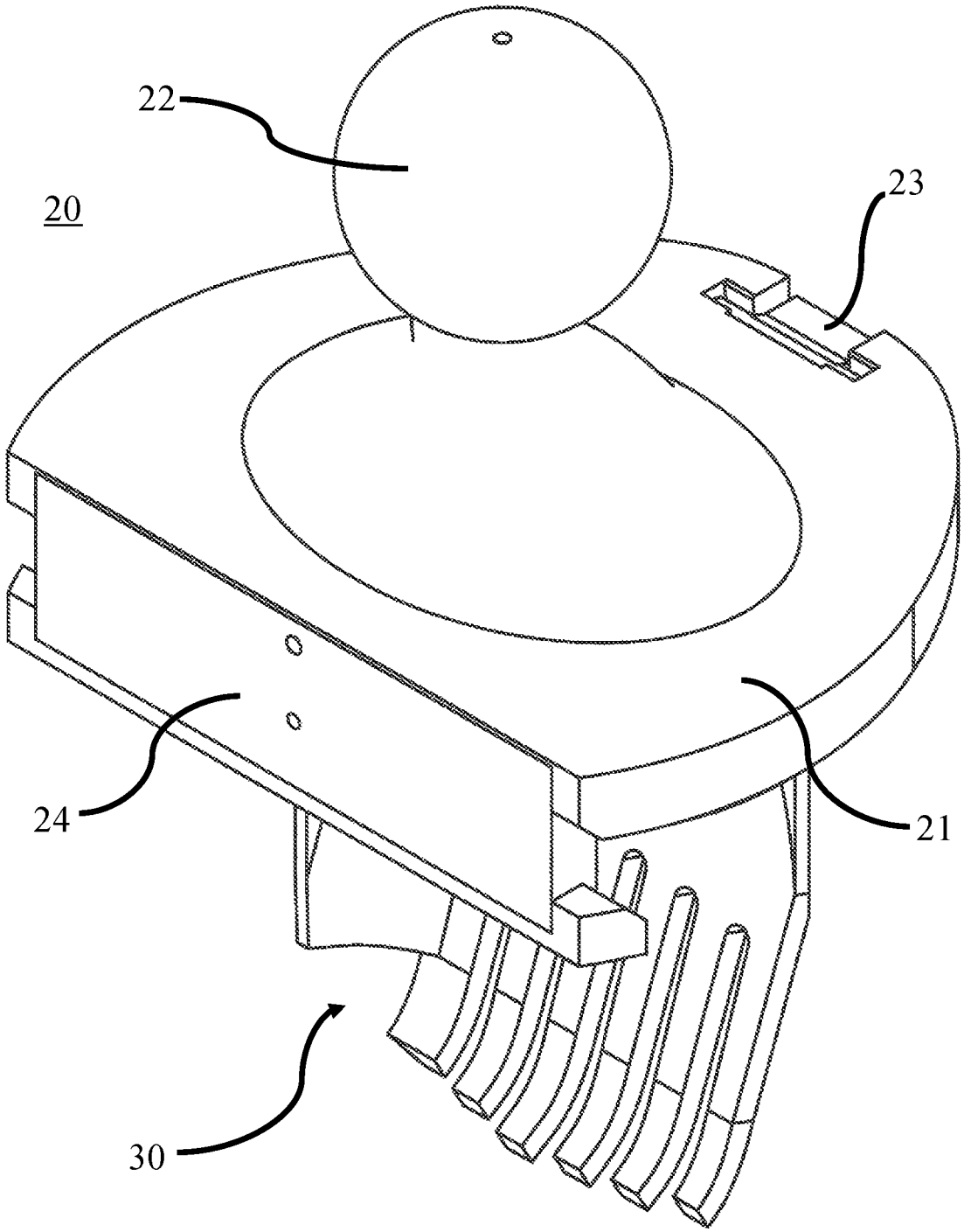
FIG. 2*a* is a perspective view of an exemplary cover assembly in accordance with one embodiment.
Figure 2B:
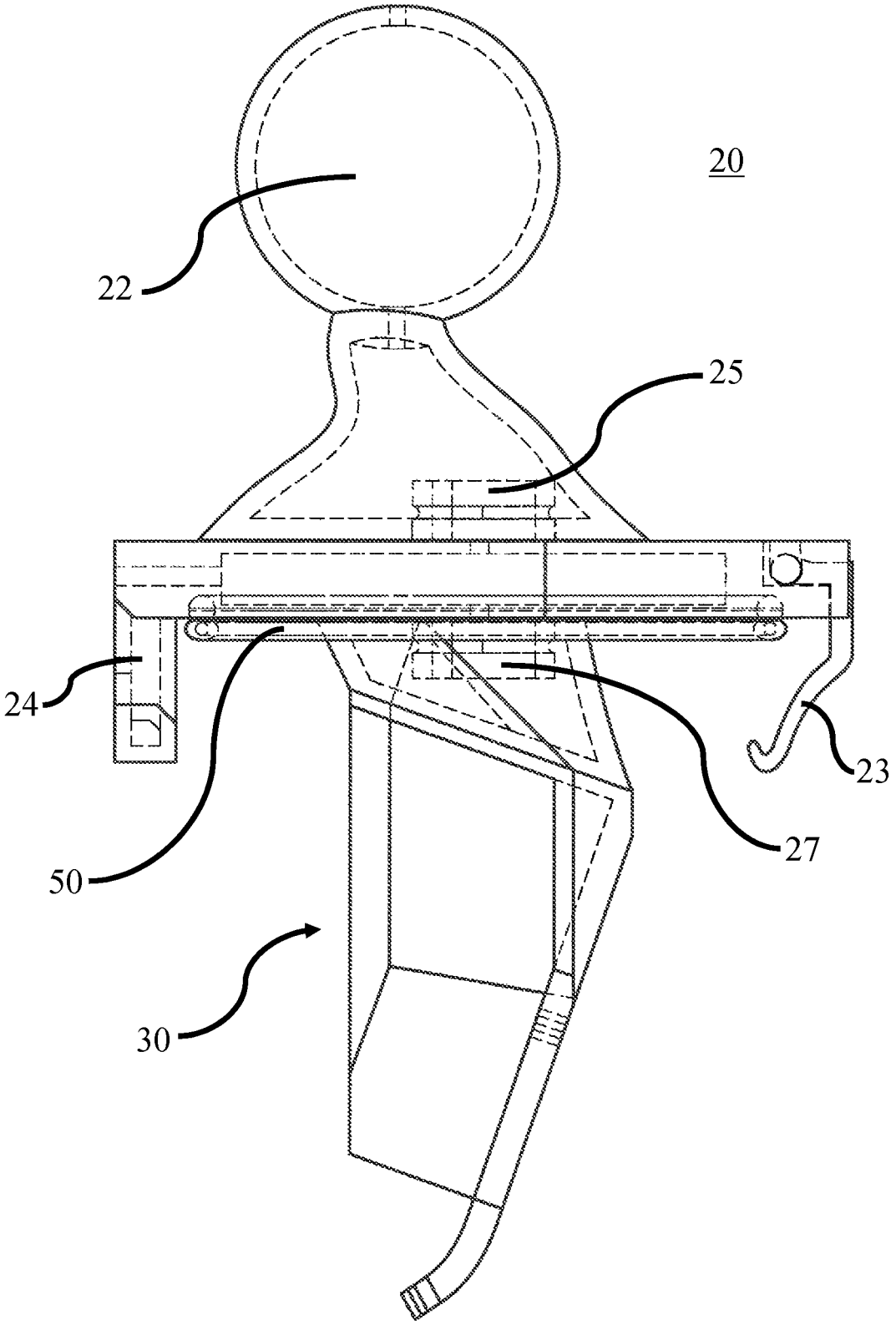
FIG. 2*b* is a side sectional view of the exemplary cover assembly shown in FIG. 2*a;*
Figure 5A:
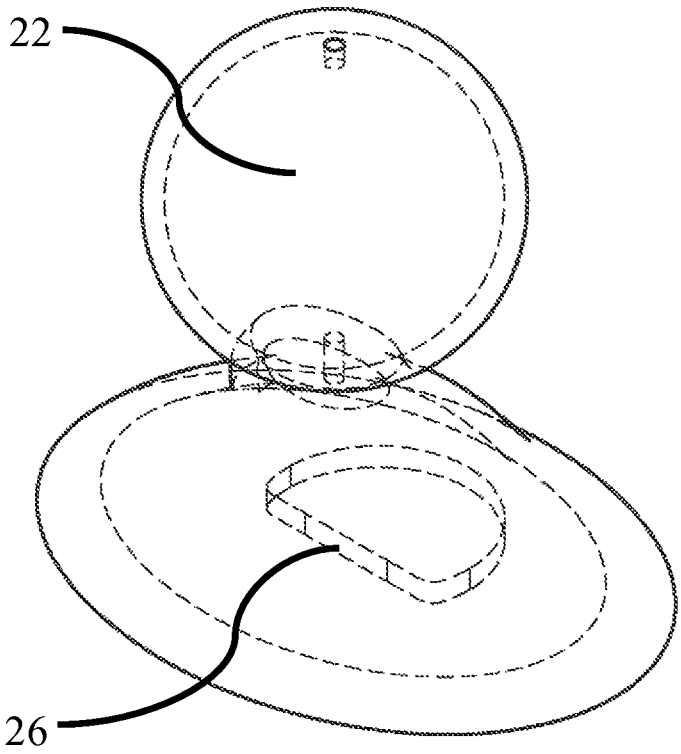
FIG. 5*a* is a sectional view of an exemplary handle portion in accordance with one embodiment.
Figure 5B:
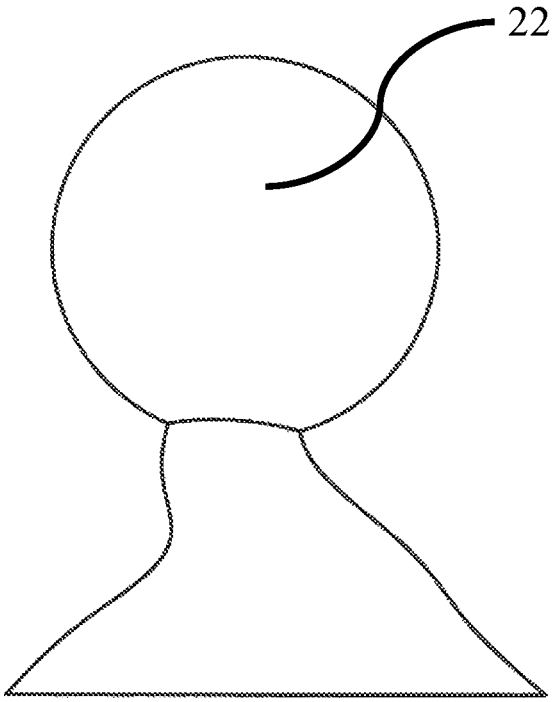
FIG. 5*b* is a side view of the handle portion in FIG. 5*a;*

An exemplary cover assembly 20 is shown in FIGS. 2*a*-2*b*. As illustrated, the cover assembly 20 may include a handle 22, a lid 21, and a retrieval member 30. The components of the cover assembly 20 may be formed as a unitary piece, or one or more components may be attachable to/detachable from the other components. The handle portion 22 (also shown in FIGS. 5*a*-5*b*) may be gripped by a user to carry the cover assembly 20 (or system 10 when the cover assembly 20 is attached to the container assembly 40), manipulate the retrieval member 30 during excrement retrieval/scooping, and the like. The handle portion 22 may be ergonomically designed to fit in the hand of a typical user.

Figure 3A:
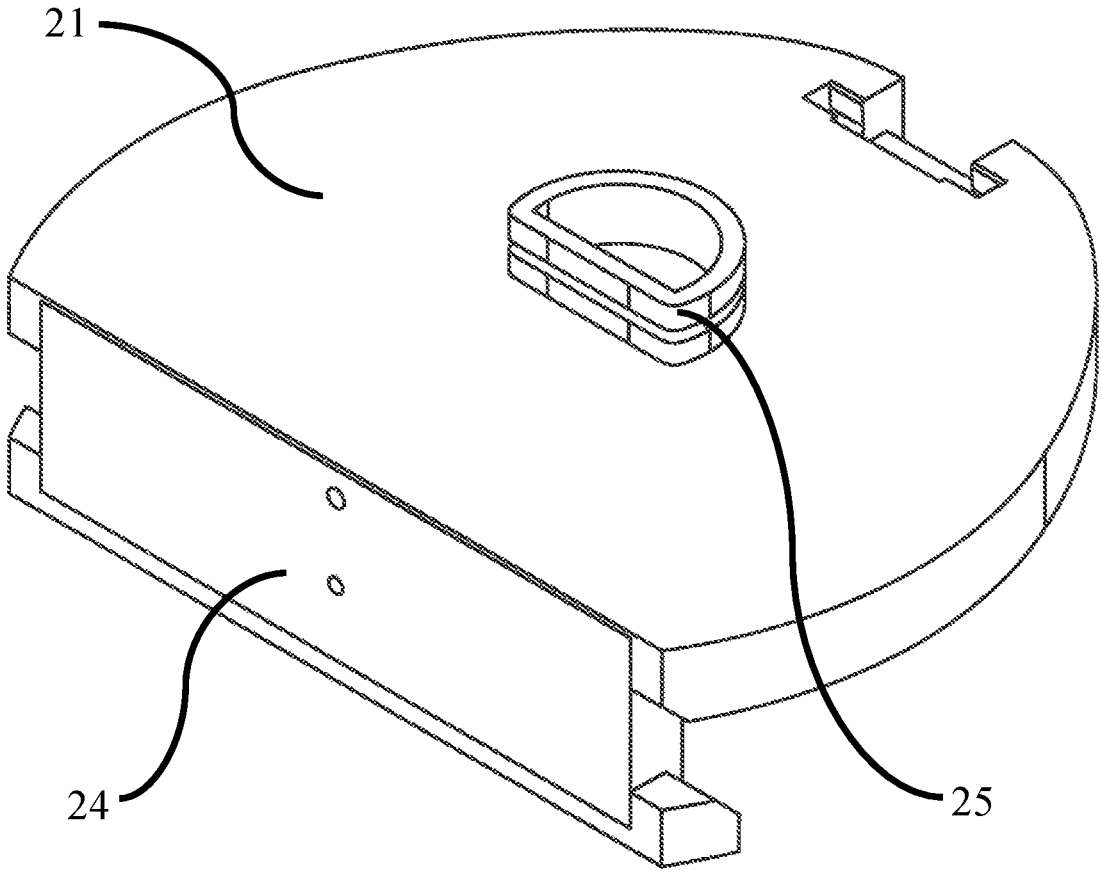
FIG. 3*a* is a perspective view of an exemplary lid portion in accordance with one embodiment.
Figure 3B:
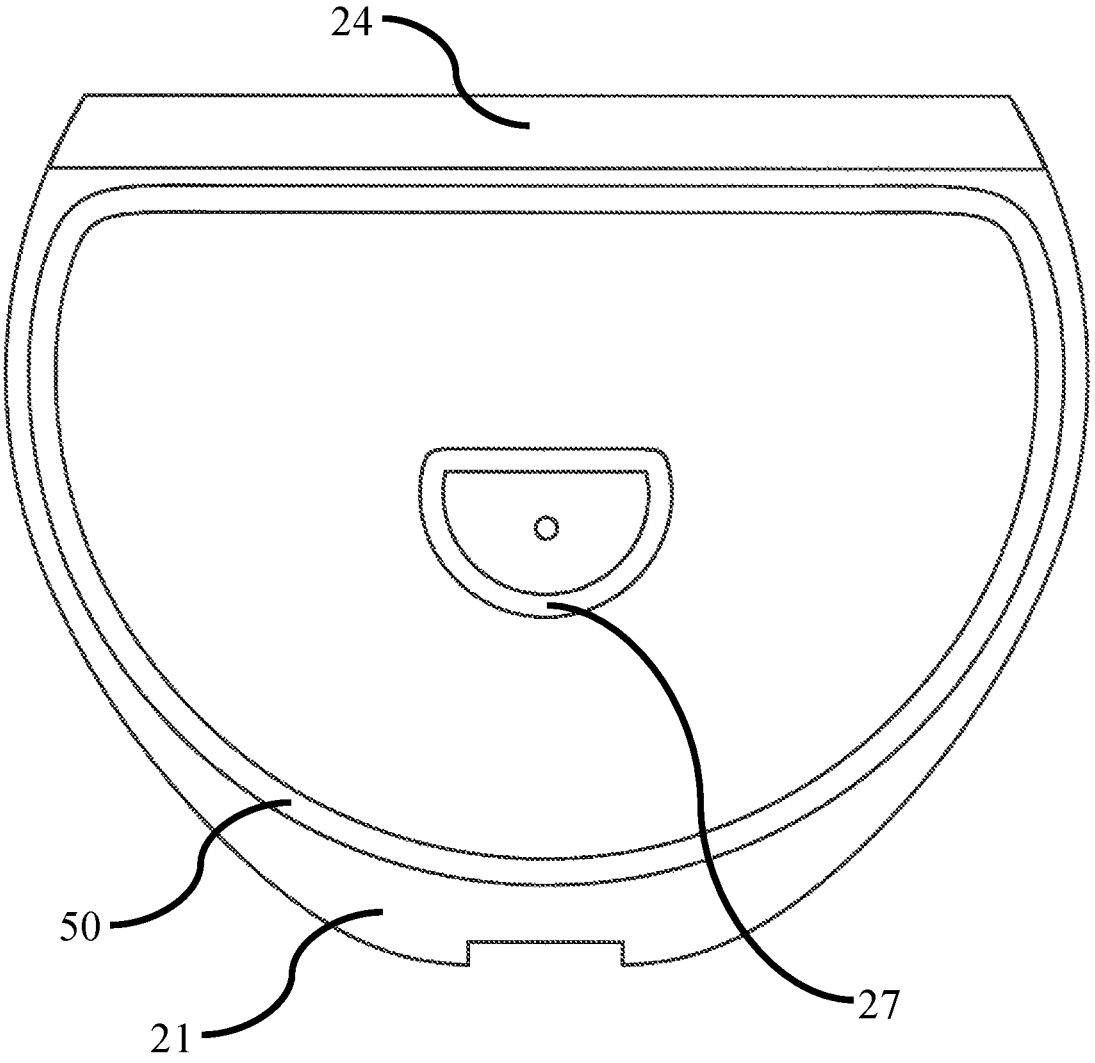
FIG. 3*b* is a bottom view the exemplary lid portion shown in FIG. 3*a;*
Figure 6A:
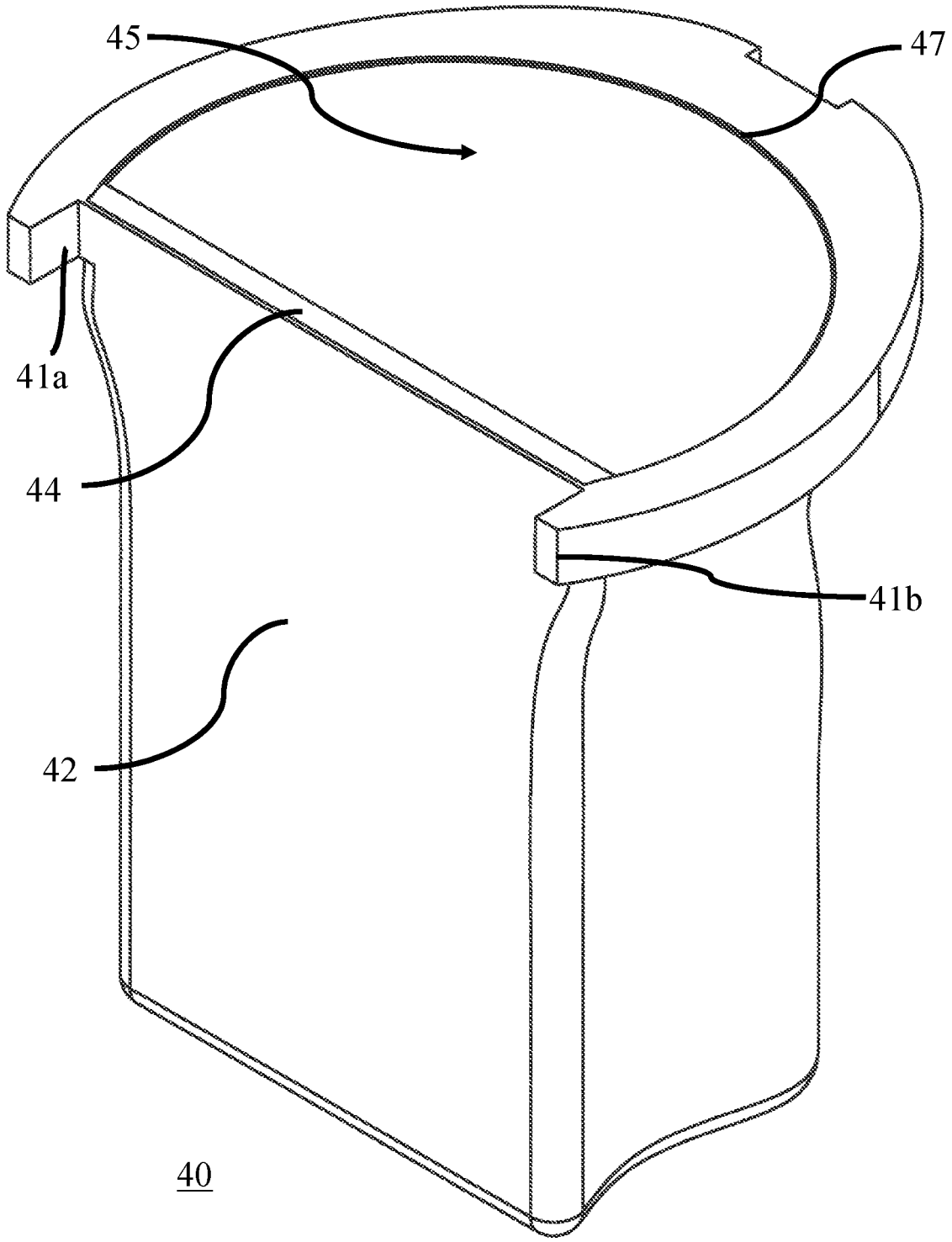
FIG. 6*a* is a perspective view of an exemplary container assembly in accordance with one embodiment.
Figure 6B:
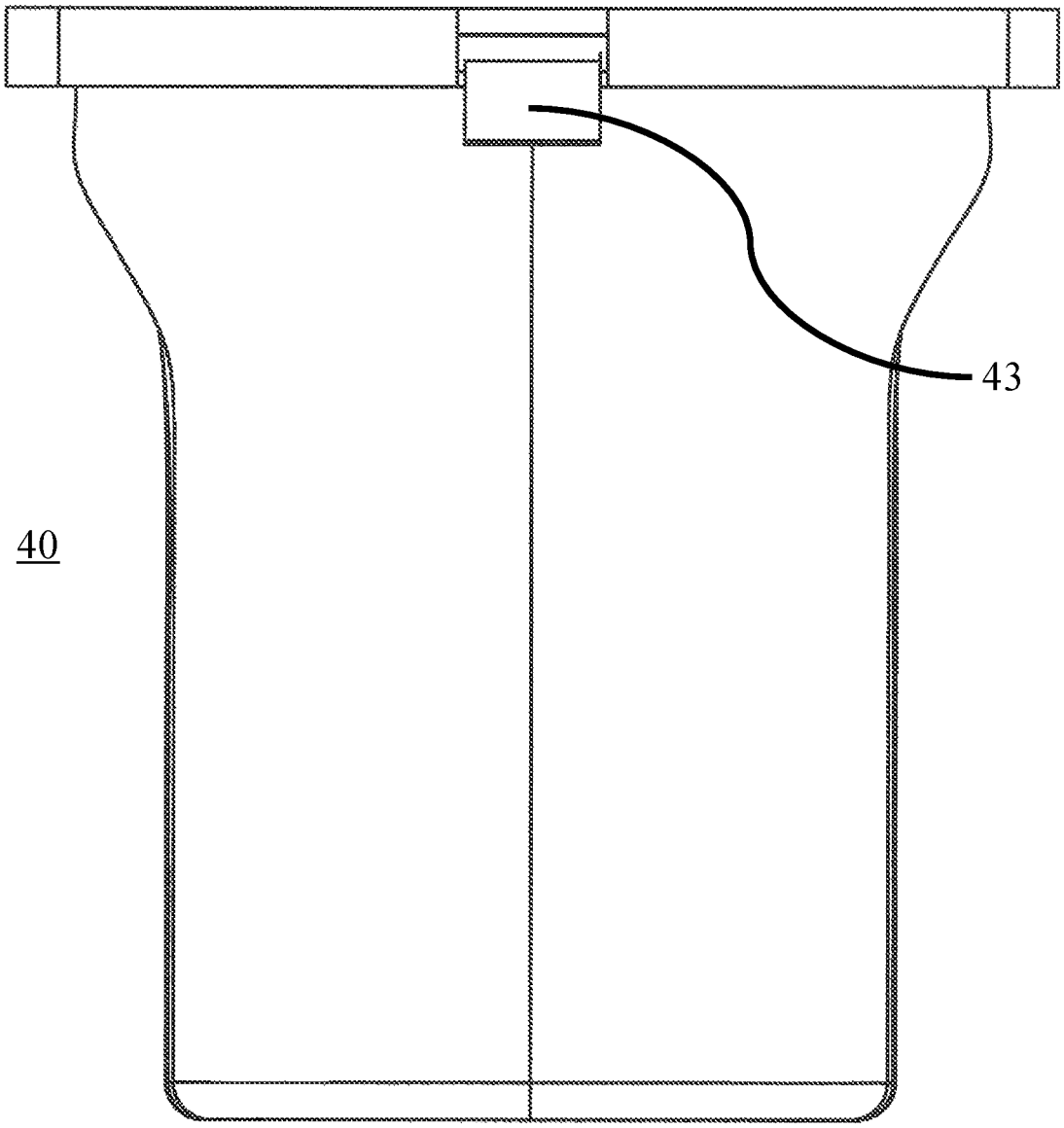
FIG. 6*b* is a front view of the exemplary container assembly shown in FIG. 6*a;*
Figure 8A:
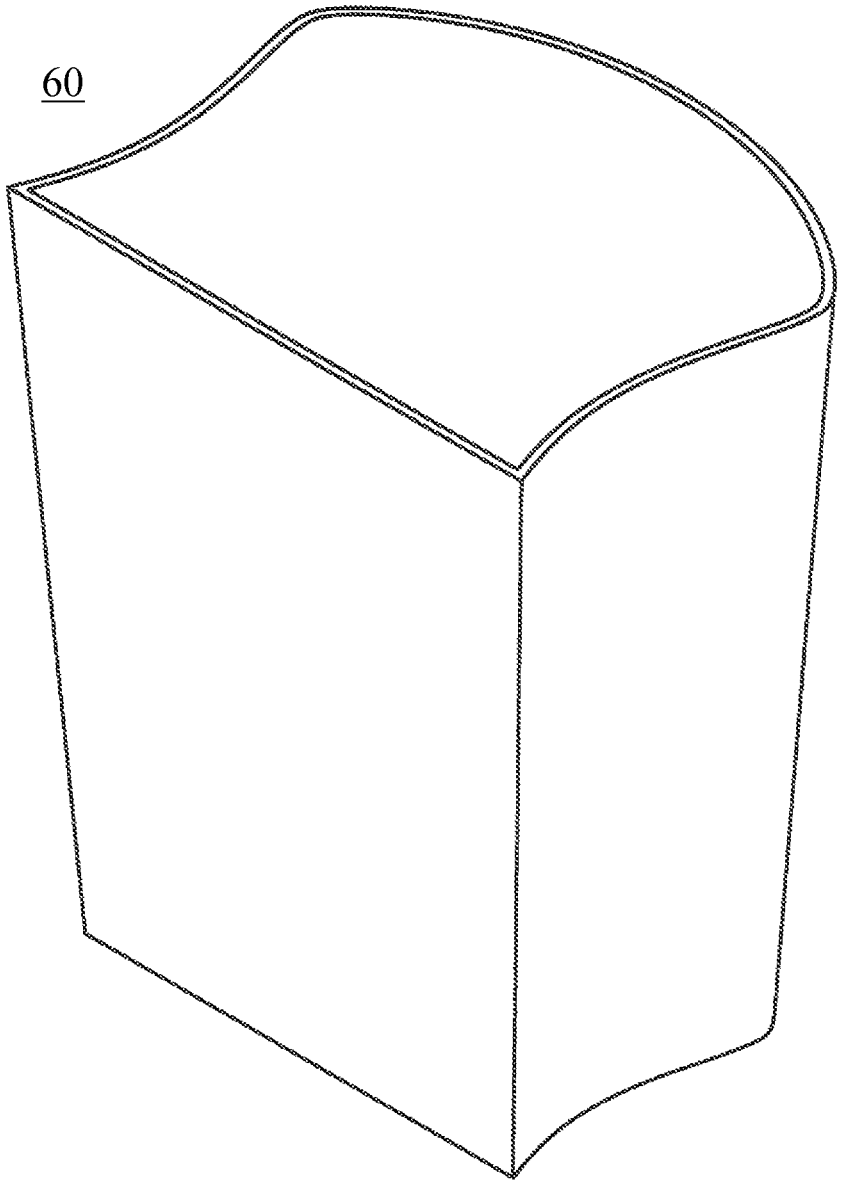
FIG. 8*a* is a perspective view an exemplary insertable liner for use with the container assembly, such as the container assembly shown in FIG. 6*c*.
Figure 8B:
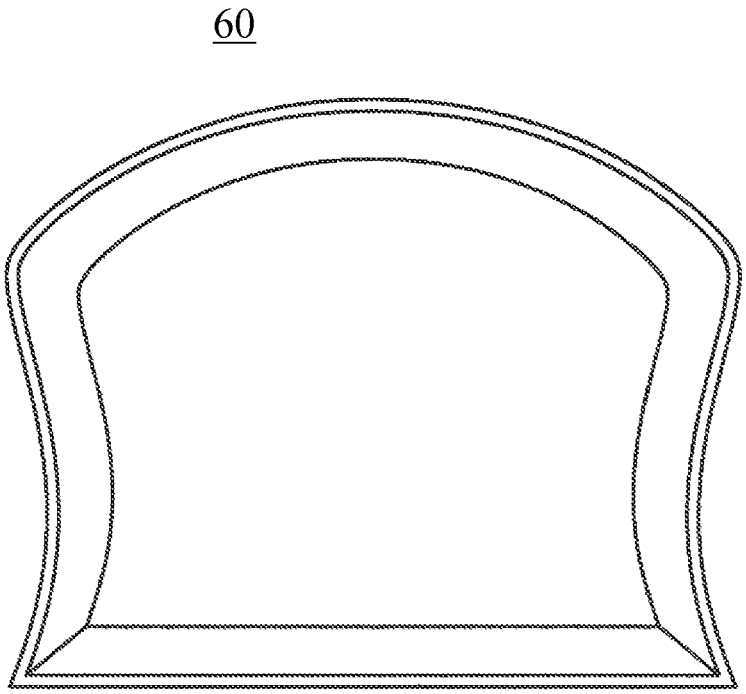
FIG. 8*b* is top view an exemplary insertable liner for use with the container assembly shown in FIG. 6*c* (or FIG. 6*a*).

Referring also to FIGS. 3*a*-3*b*, an exemplary lid 21 is shown. The lid 21 may be configured to attach to and detach from the container assembly 40 and operate to close the primary opening 47 of the container assembly 40 to secure the excrement inside the interior chamber 45. In some embodiments, a container liner 60 (illustrated in FIGS. 8*a*-8*b*) may be positioned inside the interior chamber 45. The lid 21 may include a coupling member 24 adapted to engage corresponding portion(s) (members 41*a* and 41*b* as shown in FIGS. 6*a*-6*b*) on the container assembly 40.

As best shown in FIG. 3*b*, the lid 21 may include a gasket 50 adapted to engage the container assembly 40 and may form a seal such that the excrement and any associated smell, cleaning solution or the like may be kept inside the container assembly 40. The gasket 50 may be made of a material having a lower durometer than the materials used for the lid 21 and/or container 40.

In certain embodiments, the pet waste retrieval, transporting and disposal system may include a container and a locking lid with integrated retrieval member. As illustrated, the lid 21 may include a latch 23 that engages a detent (or the like) on the container assembly 40, which may be a second latch 43 (FIG. 6*b*). The user may disengage the lid from the container by releasing the latch 23 from detent (or second latch 43) and separating the container assembly 40 and lid assembly 20 at the interlocking connection.

Figure 1D:
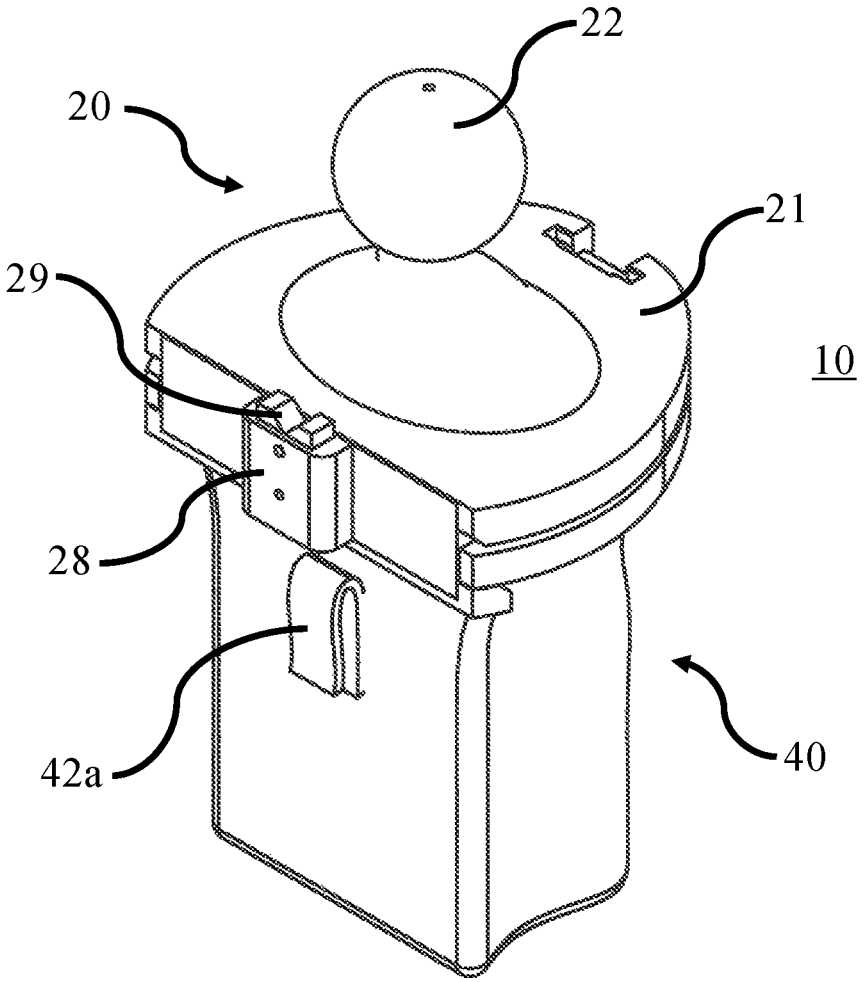
FIG. 1*d* is a perspective view of the exemplary pet waste retrieval, transporting and disposal system of FIG. 1*a* including illumination element and harness/belt attachment.
Figure 1E:
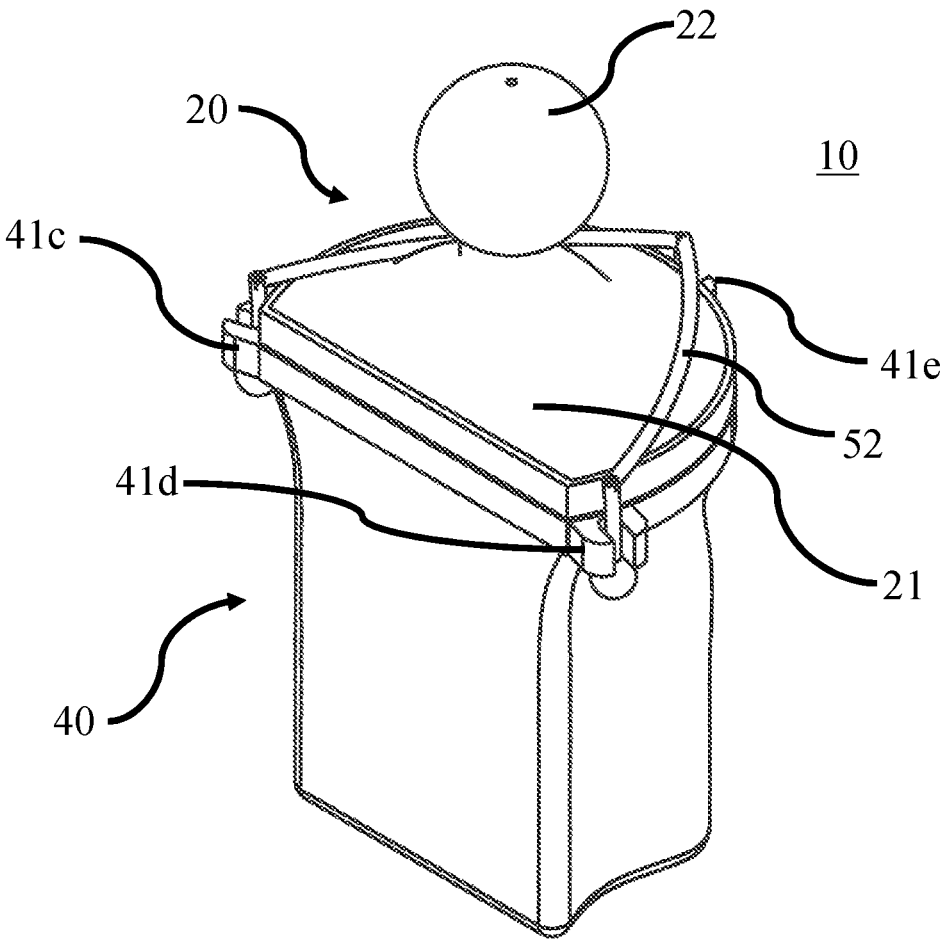
FIG. 1*e* is a perspective view of an exemplary pet waste retrieval, transporting and disposal system of FIG. 1*a* with alternate engagement or interlocking members.

Other mechanisms also may be used to couple the cover assembly 20 to the container assembly 40, such as a threaded coupling, a snap-fit coupling, elastic straps as shown in FIG. 1*e*, static bands, twist-lock, screw-on, or the like.

The width of the lid 21 may at its widest point be between about 2½ inches (nominally, about 6 centimeters) and about 9 inches (nominally, about 23 centimeters) or more, preferably between about 3 inches (nominally, about 8 centimeters) and about 7 inches (nominally, about 18 centimeters), and even more preferably between about 3¾ inches (nominally, about 8 centimeters) and about 7 inches (nominally, about 18 centimeters). In the embodiment illustrated in FIG. 3*a*, the lid 21 is about 4½ inches wide at its widest point. Other sizes may also be used.

In some embodiments, the lid 21 may include mounting members 25 and 27 for attaching to corresponding mounting member receivers 26 and 34 on the handle 22 and retrieval member 30, respectively. Such an arrangement may enable the handle 22 and/or retrieval member 30 to be detachable from the lid 21, which may assist in cleaning.

Figure 4:
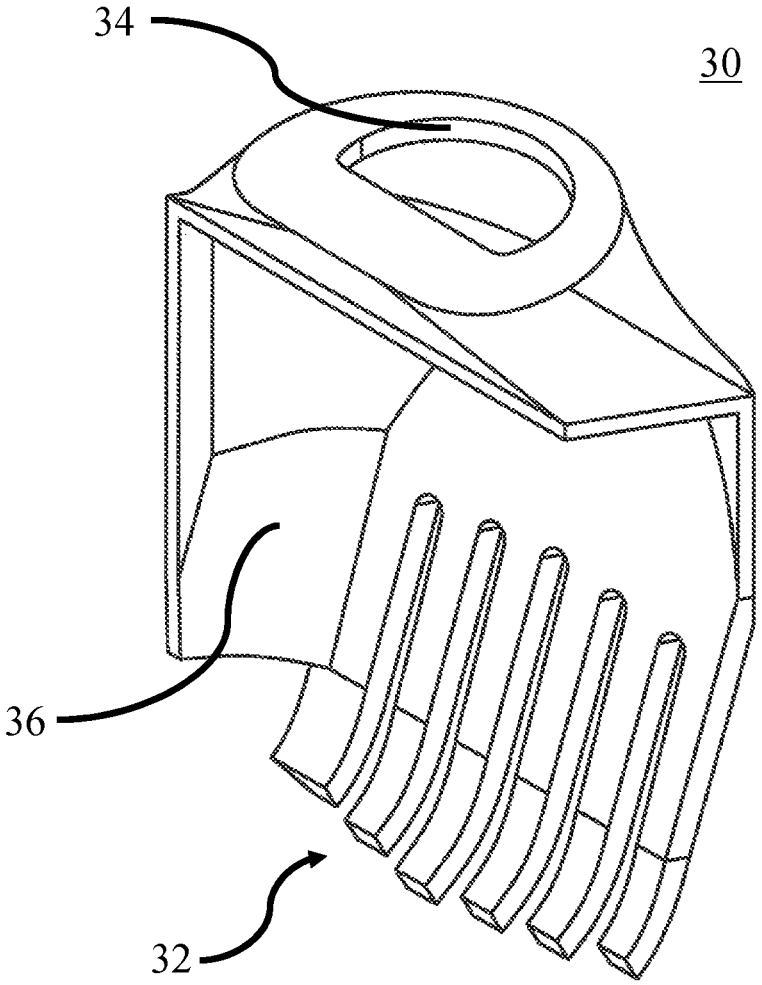
FIG. 4 is a perspective view of an exemplary retrieval member portion in accordance with one embodiment.

The retrieval member 30 may provide a mechanism for retrieving the excrement. In the embodiment illustrated in FIGS. 2*a*-2*b* and 4, the retrieval member 30 includes a set of tines 32 for scooping excrement and a side wall 36 to assist in keeping the excrement in place during retrieval. In the embodiment shown in FIG. 4, the retrieval member 30 may include a mounting member receiver 34 that engages a corresponding mounting member 27 of the lid 21.

Figure 2C:
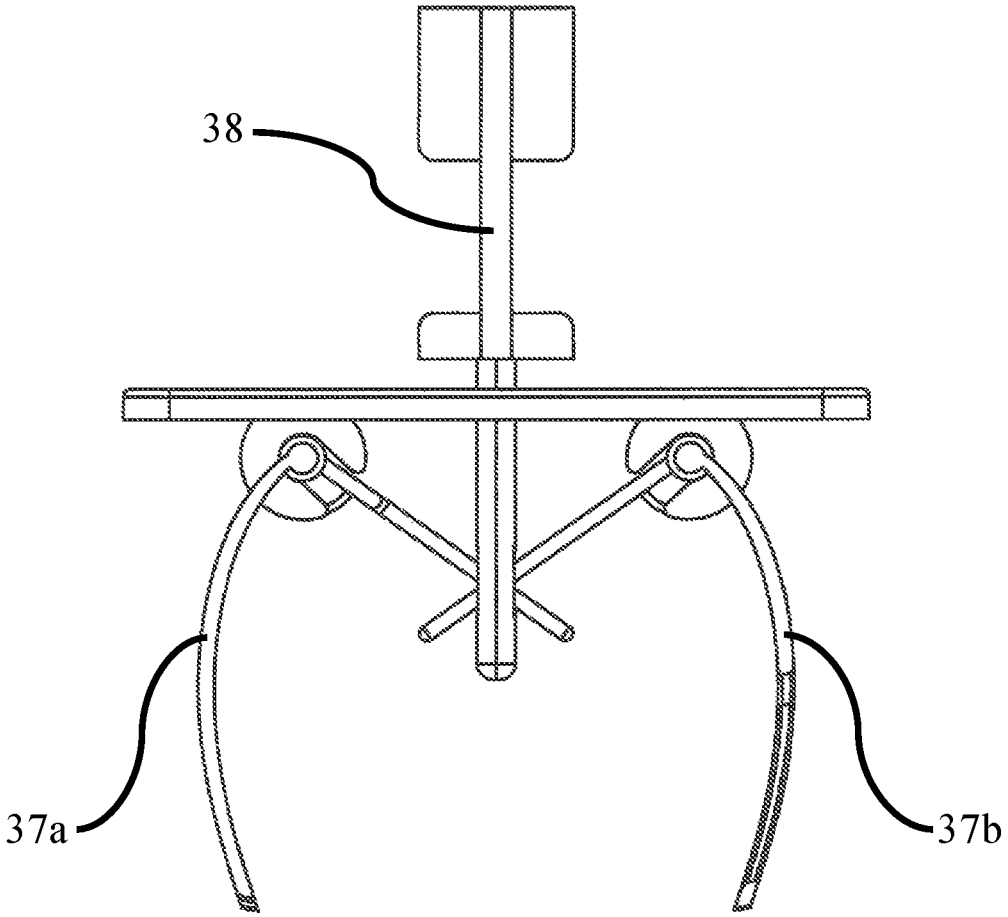
FIG. 2*c* is a side view of an exemplary cover assembly in accordance with one embodiment.

Alternatively, or additionally, in the embodiment illustrated in FIG. 2*c*, the retrieval member 30 member may include a mechanical excrement acquisition device with opposing denticulated curved plates 37*a* and 37*b* adapted to be joined and separated using a manual activator 38. The manual activator 38 may be positioned on the handle 22, such that the retrieval mechanism 30 is adapted to move from an open state to a closed state in response to activation of the manual activator 38. Other retrieval mechanisms also may be used.

The retrieval member 30 may have a length between about 2 inches (nominally, about 5 centimeters) and about 8 inches (nominally, about 23 centimeters), and preferably between about 2½ inches (nominally, about 6 centimeters) and about 5 inches (nominally, about 13 centimeters). In the embodiment illustrated in FIG. 4, the retrieval member 30 is about 4½ inches long. Other sizes may also be used.

Exemplary Container Assemblies 40

Figure 6C:
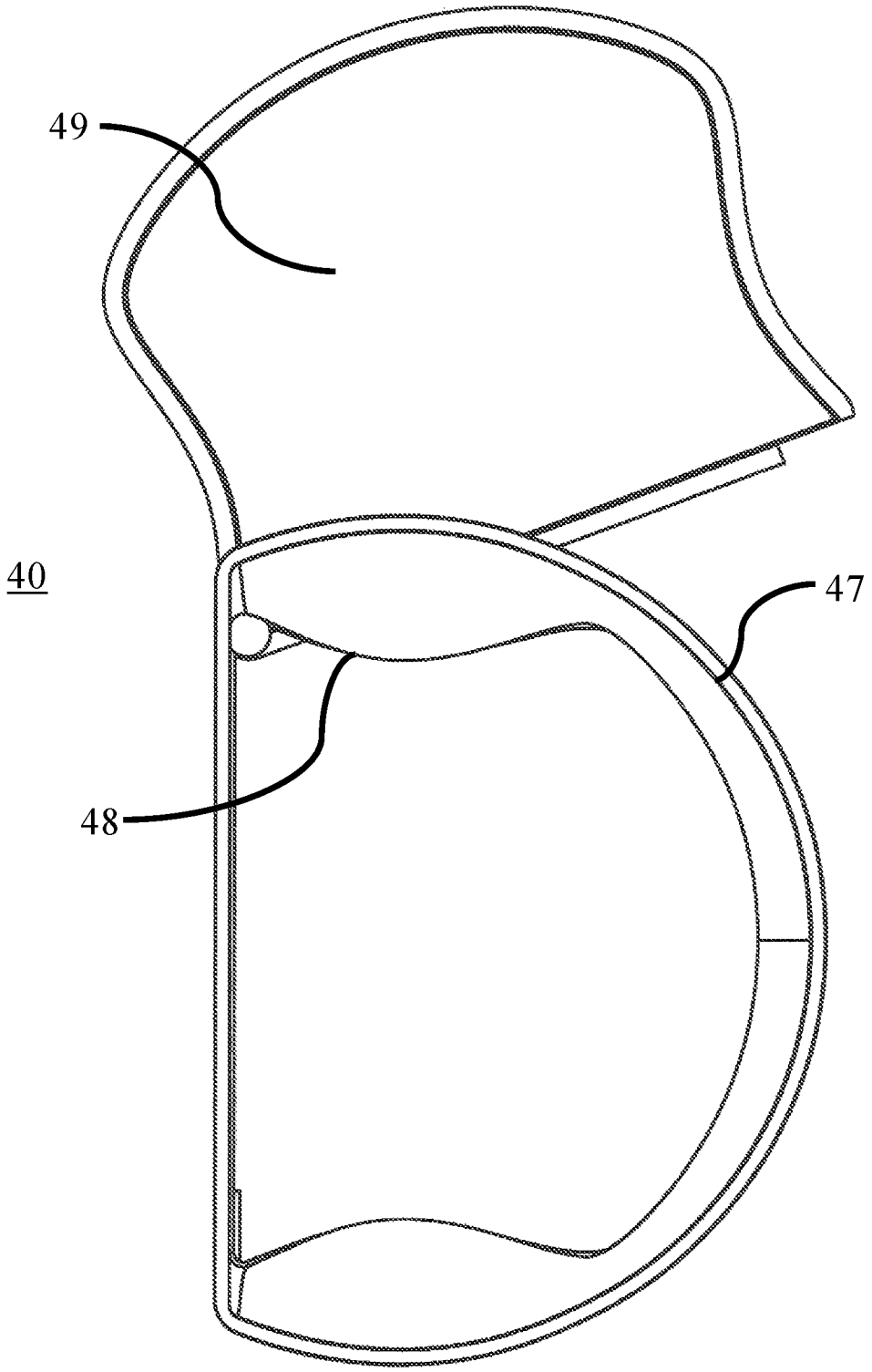
FIG. 6*c* is a top view of an exemplary container assembly in accordance with one embodiment.
Figure 7:
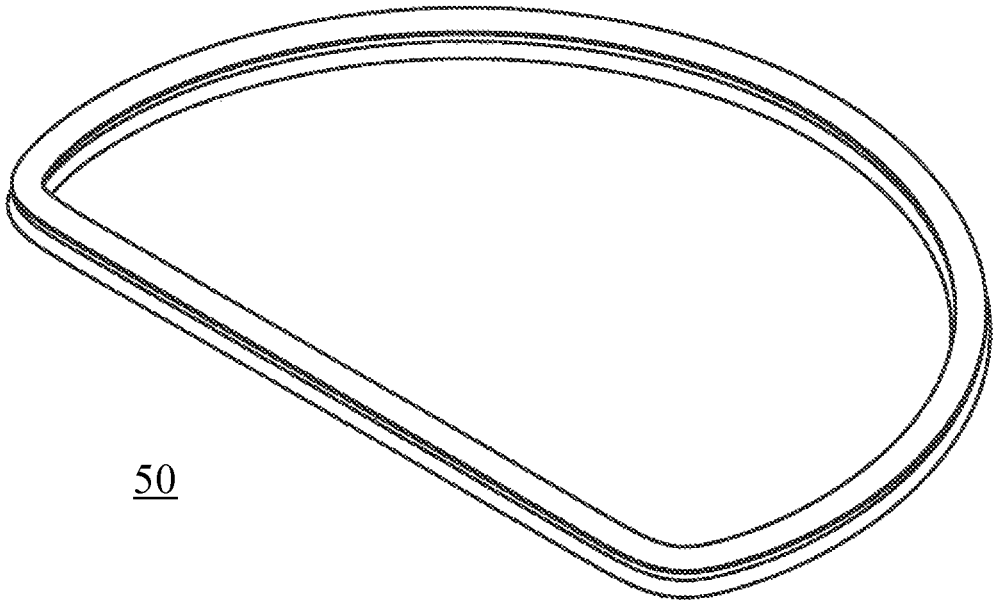
FIG. 7 is a perspective view an exemplary gasket for use with the container shown in FIG. 3*b;*

Exemplary container assemblies 40 are shown in FIGS. 6*a*-6*c*. As illustrated, the container assembly 40 may include a primary opening 47 that provides access to an interior chamber 45 that holds the excrement during transport and/or disposal, and a coupling portion 44 for coupling the cover assembly 20. The coupling portion 44 of the container assembly 40 may be any suitable mechanism for coupling the cover assembly 20. In the embodiment illustrated in FIGS. 6*a*-6*b*, the coupling portion 44 includes two posts 41*a* and 41*b* for engagement by corresponding coupling member 24 provided on the cover assembly 20.

The container assembly 40 may be formed as a unitary piece, or one or more components may be attachable to/detachable from the other components.

In some embodiments, the container assembly 40 may include a mechanism for lockingly-engaging the cover assembly 20. For example, in the embodiment illustrated in FIG. 6*b*, a latch 43 may be provided to engage a corresponding latch 23 on the cover assembly 20. In some embodiments, strap anchors 41*c*, 41*d* and 41*e* (illustrated in FIG. 1*e*) may be used to secure the container assembly 40 and cover assembly 20. Strap anchors 41*c*-*e* may work in conjunction with a strap 52 (such as an elastic strap or the like) to secure the cover assembly 20 to the container assembly 40. Alternatively, or additionally, other locking mechanisms also may be used to secure the container assembly 40 and cover assembly 20.

The width of the opening 47 may at its widest point be between about 2½ inches (nominally, about 6 centimeters) and about 9 inches (nominally, about 23 centimeters) or more, preferably between about 3 inches (nominally, about 8 centimeters) and about 7 inches (nominally, about 18 centimeters), and may have a depth between about 2½ inches (nominally, about 6 centimeters) and about 8 inches (nominally, about 23 centimeters), and preferably between about 7 inches and about 12 inches (nominally, about 30 centimeters). Other sizes may also be used.

Other Optional Features

In some embodiments, such as the embodiment shown in FIG. 6*c* the container assembly 40 may include a secondary opening 48 or access port for removing the excrement from the interior chamber 45 of the container assembly 40. The secondary opening 48 may be disposed, for example, at or near the end distal the primary opening 47. A secondary cover 49 may be provided to close and/or seal the secondary opening 48, such as, for example, a hinged door, snap-on cover, screw-on lid or the like. In some embodiments, a gas/liquid tight seal between container assembly 40 and second cover 49 using a friction-type seal. In some embodiments, a biodegradable liner 60 (FIGS. 8*a*-8*b*) can be placed into the container assembly 40 and can be released through secondary opening 48 by way of releasing secondary cover 49.

In some embodiments, as illustrated in FIG. 1*d*, the container assembly 40 may include a flat surface 42 and/or a hands-free mounting member 42*a*, such as a belt clip, strap (integrated or removable) or other element for attaching the system 10 to user or otherwise making the device easier for the user to transport. For example, a harness or belt-clip may be provided to be worn by the user, enabling the user to transport the system 10 hands-free. The container assembly 40 may be detached from the harness when necessary.

In some embodiments, as illustrated in FIG. 1*d*, the lid assembly 20 may include an illuminating device 28 and toggle switch 29 to assist the user when visibility is hampered by poor lighting situations such as nighttime, enclosed space, heavily wooded or other such conditions

ADDITIONAL CONSIDERATIONS

Although the following text sets forth a detailed description of numerous different embodiments, it should be understood that the legal scope of the description is defined by the words of the claims set forth at the end of this patent and equivalents. The detailed description is to be construed as exemplary only and does not describe every possible embodiment since describing every possible embodiment would be impractical. Numerous alternative embodiments may be implemented, using either current technology or technology developed after the filing date of this patent, which would still fall within the scope of the claims.

The following additional considerations apply to the foregoing discussion. Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

This detailed description is to be construed as exemplary only and does not describe every possible embodiment, as describing every possible embodiment would be impractical, if not impossible. One may implement numerous alternate embodiments, using either current technology or technology developed after the filing date of this application.

Those of ordinary skill in the art will recognize that a wide variety of modifications, alterations, and combinations can be made with respect to the above described embodiments without departing from the scope of the invention, and that such modifications, alterations, and combinations are to be viewed as being within the ambit of the inventive concept.

The patent claims at the end of this patent application are not intended to be construed under 35 U.S.C. § 112(f) unless traditional means-plus-function language is expressly recited, such as "means for" or "step for" language being explicitly recited in the claim(s). The systems and methods described herein are directed to an improvement to computer functionality, and improve the functioning of conventional computers.

We claim:

1. A pet waste retrieval, transporting, and disposal system comprising:

a container assembly having an opening a first portion that is substantially cylindrical having a first diameter, a second portion that is substantially cylindrical having a second diameter, the second diameter smaller than first diameter; and a cover assembly removably attachable to the container assembly, the cover assembly including a lid portion, a retrieval member and a handle, where the retrieval member and the handle are attached to the lid portion, and where the lid portion is adapted to close the opening of the container assembly when the cover assembly is in an attached position.

2. The pet waste retrieval, transporting and disposal system as recited in claim 1, where the retrieval member comprises a mechanical excrement acquisition device with opposing denticulated curved plates adapted to be joined and separated using a manual activator.

3. The pet waste retrieval, transporting and disposal system as recited in claim 2, where the manual activator is positioned on the handle.

4. The pet waste retrieval, transporting and disposal system as recited in claim 3, where the retrieval member, is adapted to move from an open state to a closed state in response to activation of the manual activator.

5. The pet waste retrieval, transporting and disposal system as recited in claim 1, where the cover assembly further comprises an illuminating element.

6. The pet waste retrieval, transporting and disposal system as recited in claim 5, where the cover assembly further comprises a switch coupled to the illuminating element.

7. The pet waste retrieval, transporting and disposal system as recited in claim 1, where at least a portion of the container assembly is made of a material selected from the group comprising stainless steel, carbon fiber, acetal resin, inorganic solid material, thermoplastic polymer and thermosetting polymer.

8. The pet waste retrieval, transporting and disposal system as recited in claim 7, whereas the material has at least one selected from the group comprising a non-corrosive property, an antimicrobial property, and a static or dynamic coefficient of friction sufficient to allow gravitational removal of organic waste.

9. The pet waste retrieval, transporting and disposal system as recited in claim 1, further comprising a pliable gasket disposed between the container assembly and the lid when the cover assembly is in the attached position, where the lid and gasket are adapted to seal the opening of the container assembly when the cover assembly is in the attached position.

10. The pet waste retrieval, transporting and disposal system as recited in claim 1, where the cover assembly can be mechanically engaged and disengaged to the container assembly.

11. The pet waste retrieval, transporting and disposal system as recited in claim 1, where the cover assembly is adapted to seal the opening of the container assembly when the cover assembly in in the attached position.

12. The pet waste retrieval, transporting and disposal system as recited in claim 1, where container assembly further includes a secondary opening distal the opening, the system further comprising a secondary cover adapted to close the secondary opening.

13. The pet waste retrieval, transporting and disposal system as recited in claim 1, further comprising a liner adapted to line an interior chamber of the container assembly.

14. The pet waste retrieval, transporting and disposal system as recited in claim 1, where the container assembly further includes a hands-free mounting member.

15. The pet waste retrieval, transporting and disposal system as recited in claim 1, where the container assembly includes a flared portion disposed adjacent the opening.

16. A pet waste retrieval, transporting, and disposal system comprising:

a container assembly having an opening, a first portion that is substantially cylindrical having a first diameter, a second portion that is substantially cylindrical having a second diameter, the second diameter smaller than first diameter;

a cover assembly removably attachable to the container assembly, the cover assembly including a lid portion, a retrieval member and a handle, where the retrieval member and the handle are attached to the lid portion, where the lid portion is adapted to close the opening of the container assembly when the cover assembly is in an attached position; and a pliable gasket disposed between the container assembly and the lid when the cover assembly is in the attached position, where the cover assembly is adapted to seal the opening of the container assembly when the cover assembly is in the attached position.

17. The pet waste retrieval, transporting and disposal system as recited in claim 16, where the container assembly further includes a secondary opening distal the opening, the system further comprising a secondary cover adapted to close the secondary opening.

18. The pet waste retrieval, transporting and disposal system as recited in claim 16, where the cover assembly further comprises an illuminating element.

19. The pet waste retrieval, transporting and disposal system as recited in claim 16, where at least a portion of the container assembly is made of at least one material selected from the group comprising metal, carbon fiber, acetal resin, inorganic solid material, thermoplastic polymer, and thermosetting polymer.

20. The pet waste retrieval, transporting and disposal system as recited in claim 16, where the container assembly further includes a hands-free mounting member.

21. A pet waste retrieval, transporting, and disposal system comprising:

a container assembly having a primary opening, a first portion that is substantially cylindrical having a first diameter, a second portion that is substantially cylindrical having a second diameter, the second diameter smaller than first diameter, an optional secondary opening distal the primary opening, a secondary cover adapted to close the secondary opening, and a hands-free mounting member; and a cover assembly removably attachable to the container assembly, the cover assembly including a lid portion, a retrieval member, a handle and an illuminating element, where the retrieval member and the handle are attached to the lid portion, where the lid portion is adapted to close the opening of the container assembly when the cover assembly is in an attached position;

where the cover assembly is adapted to seal the opening of the container assembly when the cover assembly is in the attached position, and where at least a portion of the container assembly or cover assembly is made of at least one rigid or semi-rigid material selected from the group comprising metal, carbon fiber, acetal resin, inorganic solid material, thermoplastic polymer and thermosetting polymer.

* * * * *